US008292454B2

(12) United States Patent
Schrimmer

(10) Patent No.: US 8,292,454 B2
(45) Date of Patent: Oct. 23, 2012

(54) EXTERNALLY SWITCHABLE ILLUMINATED BALLOON INFLATOR

(75) Inventor: Michael L. Schrimmer, Vernon Hills, IL (US)

(73) Assignee: Chemical Light, Inc., Vernon Hills, IL (US)

( * ) Notice: Subject to any disclaimer, the term of this patent is extended or adjusted under 35 U.S.C. 154(b) by 435 days.

(21) Appl. No.: 12/537,835

(22) Filed: Aug. 7, 2009

(65) Prior Publication Data

US 2009/0296372 A1 Dec. 3, 2009

Related U.S. Application Data

(63) Continuation-in-part of application No. 12/032,876, filed on Feb. 18, 2008, now Pat. No. 7,850,328, which is a continuation of application No. 10/904,486, filed on Nov. 12, 2004, now Pat. No. 7,344,267.

(51) Int. Cl.
*F21L 4/00* (2006.01)

(52) U.S. Cl. ..... 362/189; 362/205; 362/206; 362/184; 362/194; 362/195

(58) Field of Classification Search ..... 362/180, 362/184, 194, 195, 196, 205, 206, 398, 806, 362/18; 446/219, 222, 224, 220
See application file for complete search history.

(56) References Cited

U.S. PATENT DOCUMENTS

| | | | | |
|---|---|---|---|---|
| 7,344,267 | B2 | 3/2008 | Carito | |
| 7,478,779 | B2 | 1/2009 | Nguyen et al. | |
| 2002/0145863 | A1 * | 10/2002 | Stultz | 362/96 |
| 2009/0067154 | A1 | 3/2009 | Carito | |
| 2009/0084892 | A1 | 4/2009 | Nguyen et al. | |

* cited by examiner

*Primary Examiner* — Sharon Payne
(74) *Attorney, Agent, or Firm* — Levenfeld Pearlstein, LLC

(57) ABSTRACT

An illuminated inflator for inserting into the neck of a balloon includes a gas-tight flange having a periphery, a center, and upper and lower surfaces. A filler tube has upper and lower ends and extends through the flange, with the lower end of the filler tube extending below the lower surface the flange and the upper end of the filler tube extending above the upper surface of the flange. A one-way valve is in flow communication with the filler tube. A light assembly includes a power source and at least one light element electrically connected to the power source. The light assembly is operably mounted to the flange at the upper surface thereof. A switch is operably connected to the power source and the at least one light element for providing power to and isolating power from the at least one light element. The inflator is inserted into the balloon with the flange in the neck of the balloon defining a pressure region boundary. The bottom of the filler tube extends outside of the pressure region boundary for filling the balloon with a gas, such that the one-way valve prevents gas from escaping from the pressure region boundary through the filler tube. The switch is mounted to the inflator outside of the pressure region boundary to allow actuation/access to the switch without access to the pressure boundary and without contacting the balloon.

9 Claims, 6 Drawing Sheets

EXTERNALLY SWITCHABLE ILLUMINATED BALLOON INFLATOR

CROSS-REFERENCE TO RELATED APPLICATION DATA

This application is a continuation-in-part of U.S. patent application Ser. No. 12/032,876, filed Feb. 18, 2008, which is a continuation of U.S. patent application Ser. No. 10/904,486, filed Nov. 12, 2004, now U.S. Pat. No. 7,344,267.

BACKGROUND OF THE INVENTION

The present invention relates to illuminated toy balloons. More particularly, the present invention relates to improved switch arrangements for illuminated balloon inflators. The use of lights in association with balloons is well known. Examples include U.S. Pat. Nos. 6,390,651 and 5,215,492. Also well known is the use of chemiluminescent materials or light sticks that produce light by chemical reaction which may be inserted into balloons.

The present invention is an improvement over the known illuminated balloons in which an inexpensive, self-powered apparatus is inserted into the neck of a balloon, which contains a small, energy-efficient light source powered by a battery, and which includes a switch in the interior of the balloon to turn the light on and off.

While such illuminated balloons are known and function well, actuation of the switch can be difficult when it is located within the interior of the balloon.

Accordingly, there is a need for an illuminated balloon inflator in which the illuminated inflator apparatus is inserted in the balloon, the balloon then filled with a gas such as helium or air, and the light is easily switched on or off as desired.

SUMMARY OF THE INVENTION

An illuminated inflator for inserting into the neck of a balloon includes a gas-tight flange having a periphery, a center, and upper and lower surfaces. A filler tube has upper and lower ends and extends through the flange, with the lower end of the filler tube extending below the lower surface the flange and the upper end of the filler tube extending above the upper surface of the flange. A one-way valve is in flow communication with the filler tube.

A light assembly includes a power source and at least one light element electrically connected to the power source. The light assembly is operably mounted to the flange at the upper surface thereof.

A switch is operably connected to the power source and the at least one light element for providing power to and isolating power from the at least one light element. The inflator is inserted into the balloon with the flange in the neck of the balloon defining a pressure region boundary. The bottom of the filler tube extends outside of the pressure region boundary for filling the balloon with a gas, such that the one-way valve prevents gas from escaping from the pressure region boundary through the filler tube. The switch is mounted to the inflator outside of the pressure region boundary to allow actuation/access to the switch without access to the pressure boundary and without contacting the balloon. The inflator includes an electrical connector extending between the switch and light assembly.

The light assembly is mounted to and spaced from the gas-tight flange. In a present embodiment, three legs extend between the gas-tight flange and the light assembly to elevate the light assembly into the balloon. A present light element is an LED, preferably multiple (three) LEDs. Circuitry is used to provide steady illumination, blinking illumination and flashing (e.g., a variety of illumination operating modes) of the LEDs.

The switch, which is external to the pressure boundary, can be mounted to the filler tube or to a lower surface of the flange to allow access to the switch without access to the pressure boundary and without contacting the balloon.

An opening in the lower flange accommodates the connectors (wires) and is sealed after placement/penetration of the connectors to assure the integrity of the pressure boundary.

These and other features and advantages of the present invention will be apparent from the following detailed description, in conjunction with the appended claims.

BRIEF DESCRIPTION OF DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
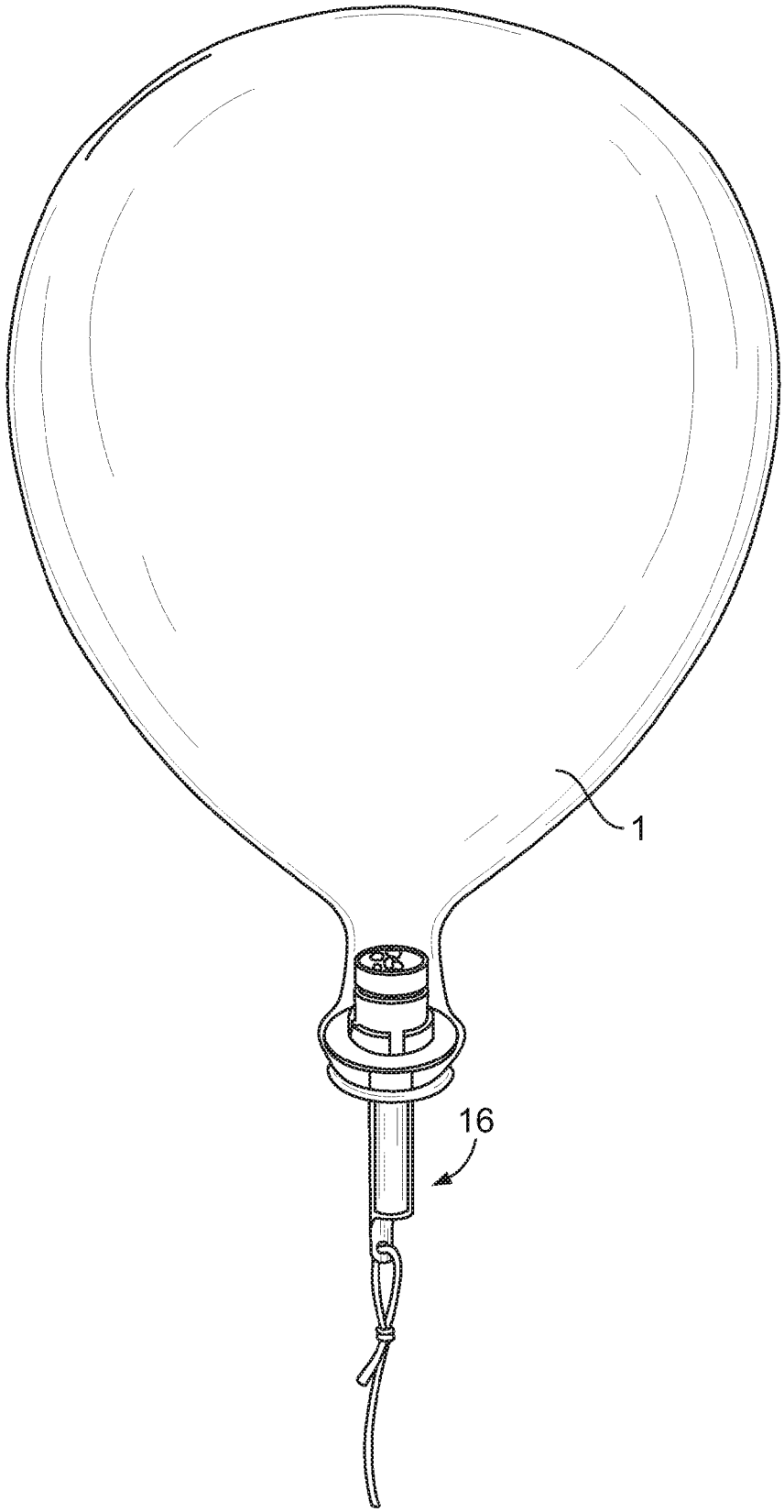
FIG. 1 depicts a perspective view of a balloon containing the apparatus for illuminating the balloon interior.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to FIG. 1, the present device 16 is inserted into the neck of a balloon, with a cord 3 attached to the device restraining the balloon. The balloon is obviously filled with a gas, which may be air, helium, or similarly inert gasses, in the case of balloons used as toys, on account of safety concerns. In other applications, where sufficient safeguards are taken, the gas need not be inert.

Figure 1A:
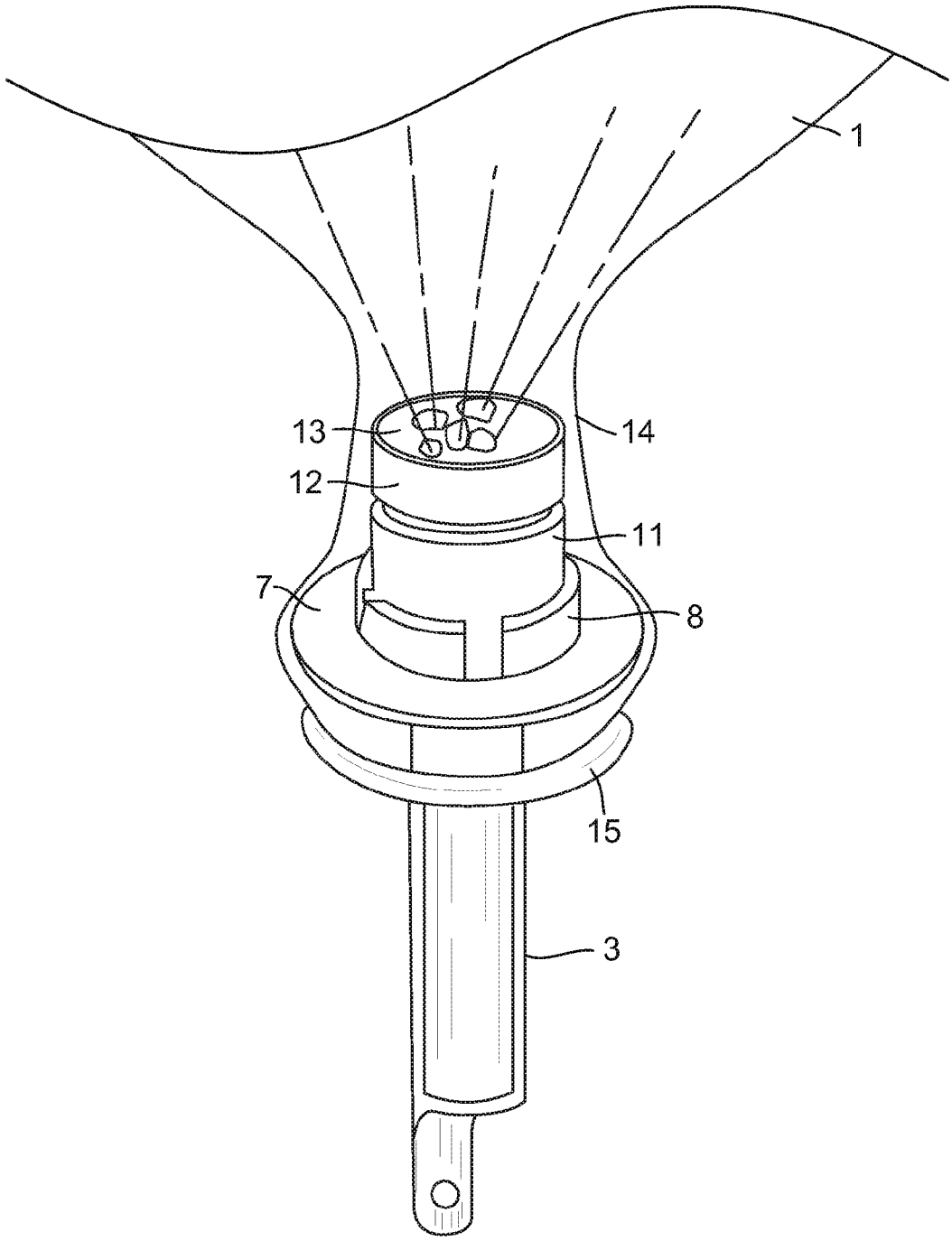
FIG. 1A depicts a detail perspective view derived from FIG. 1, showing the apparatus in greater detail.

Referring now to FIG. 1A, the details of this device are revealed. The device, in the form of a plug, contains a cylindrical body 3 which has an integrally formed radially extending flange 7 which retains the device within the balloon. When the device is inserted into the neck 14 of the balloon, the flange 7 causes the neck to provide a gas-tight seal just above the neck ring 15 at the lower end of the neck, which provides stability for the balloon with the device inserted.

Still referring to FIG. 1A, a light-emitting assembly is shown disposed above the flange 7. The assembly is made up of the light emitting surface 13, which is rigidly affixed to a screw-on cap 12, which attaches to the lower assembly housing 11. A battery which powers the light-emitting assembly is contained within the lower housing and screw-on cap. The user may turn the light on and off by screwing the cap down, and conversely screwing the cap in the opposite direction, relieving pressure and disconnecting power to the light element.

In the embodiment shown in FIG. 1A the light-emitting assembly is restrained in place by guides 8. Also contained in this embodiment is a magnet, not shown in this view, which is disposed below the base of the light-emitting assembly.

Figure 2A:
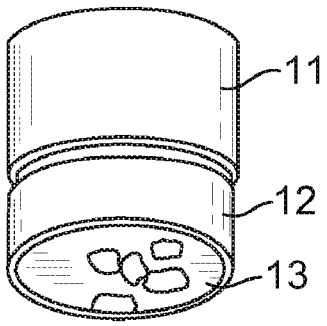
FIG. 2A depicts a light element assembly containing a battery.
Figure 2B:
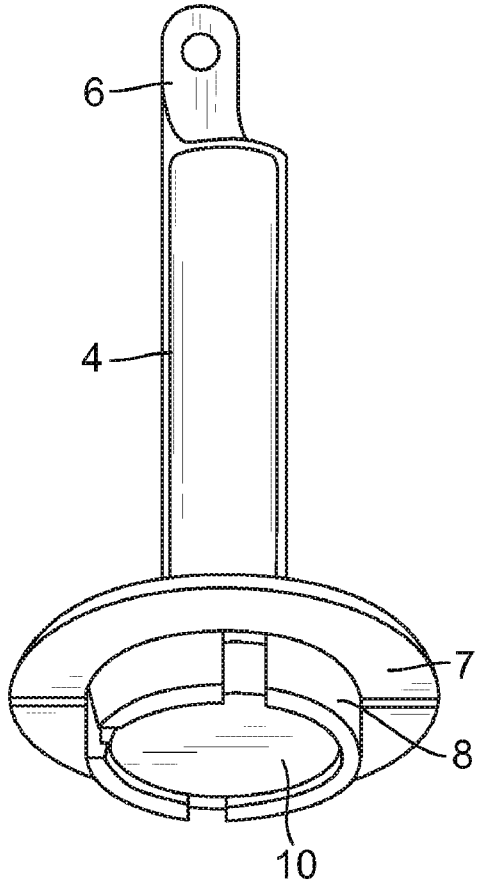
FIG. 2B depicts a perspective view of an embodiment of the apparatus using magnetic means to affix the light element to the plug.
Figure 3:
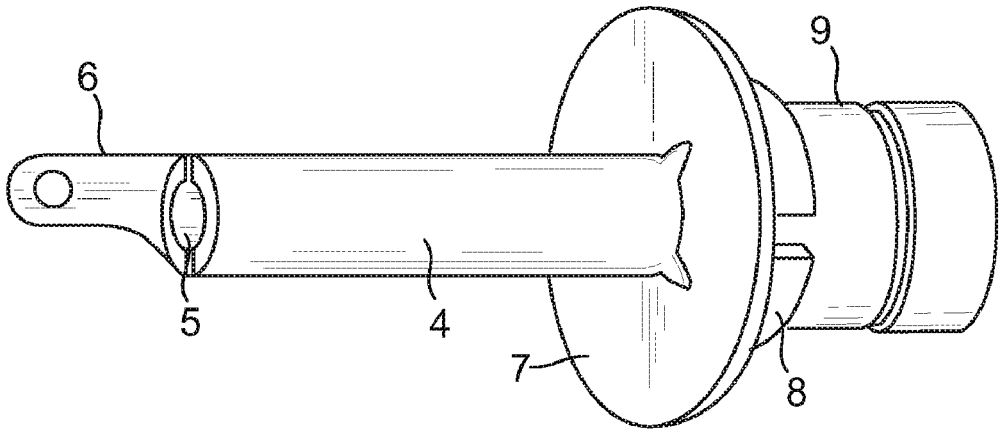
FIG. 3 depicts a perspective view of the embodiment of FIG. 2*b*, in which the light element assembly is magnetically affixed to the magnet.

The use of the magnet in this embodiment may be further understood by referring next to FIGS. 2A, 2B, and 3. FIGS. 2A and 2B depict the light-emitting assembly separated from the rest of the device. The battery 12, is clearly displayed in this figure, disposed entirely within the guides 8, and concentrically disposed directly upon the flange 7. FIG. 3 shows the two elements combined to form the device prior to insertion into the balloon. Still referring to these figures, the light-emitting assembly is mounted on the flange between the guides 8, and restrained in place by the magnet 10, which attracts the steel body of the light-emitting assembly 9. The body 4 of the device is in the form of a tube, or cylinder, which is hollow, containing a cylindrical chamber 5 and ending in a tab 6, which provides a hole to which a cord may be attached.

In order to use the device, the balloon may first be filled, typically with helium, so that the balloon floats in the air. In one embodiment the balloon is first filled with helium by means well known in the prior art, and which are not a part of this invention. The user pinches off the neck to retain the helium within the balloon, and then quickly inserts the device into the neck of the balloon. Once the insertion has been accomplished, the flange 7 provides a seal so that the helium will not escape from the balloon, except at a very, very slow rate.

In another variation of this invention, the device may contain a one-way valve, or check valve, permitting the helium to be inserted through the cylindrical chamber 5, but not allowing the helium to escape back through the chamber. In this embodiment the valve is located in the body of the device. Ports (not shown) are provided between the valve and the head of the device to allow the helium to enter the balloon, but not escape.

In this embodiment the device is first inserted into the balloon neck, as shown in FIG. 1, before filling. The helium gas is then pumped in through the cylindrical channel 5 of the body 4, which allows the balloon to fill, until the gas is shut off, relieving the pressure in the channel, and causing the check valve to shut off, retaining the pressure within the balloon indefinitely.

Figure 5B:
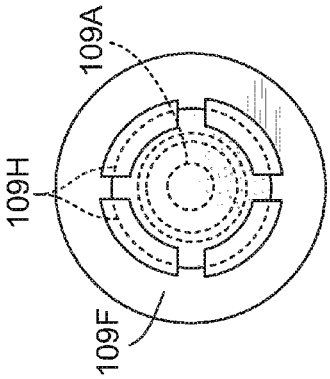
FIG. 5B (Prior Art)
FIG. 5B depicts a prior-art balloon inflation device in top plan view.
Figure 5A:
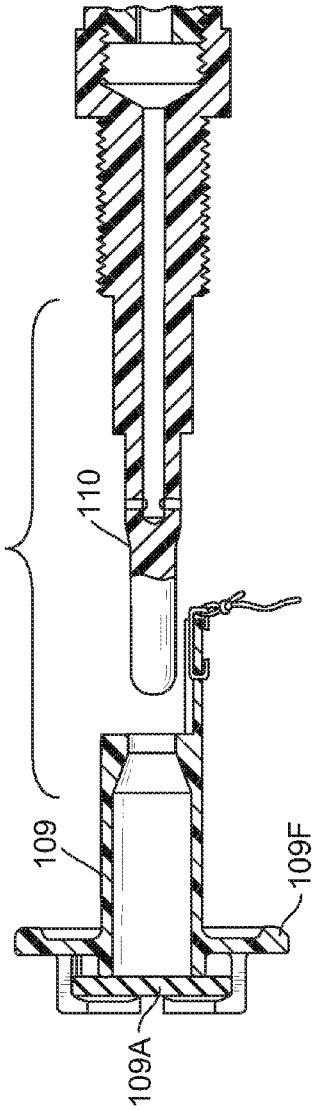
FIG. 5A (Prior Art)
FIG. 5A depicts a prior-art balloon inflation device in cross section elevation view.

The prior art describes and claims a device such a one-way valve in Zeyra, U.S. Pat. No. 4,167,204. Referring now to FIGS. 5A and 5B a basic valve in accordance with said patent is shown. The head 109 of this prior art device contains the radial flange 109F used for the same purpose as in the present patent. The check-valve effect is accomplished by means of the circular resilient disc 109A. The gas is introduced by means of the filler element 110 which is inserted into the head 109, creating pressure which forces the circular resilient disk 109A outward against the guides 109F.

In the present invention a check valve mechanism may be inserted into the body of the apparatus in order to effect the same end. Because such check valves are well known in the art, and because they are not part of the present invention, they will not be further described here.

Figure 6B:
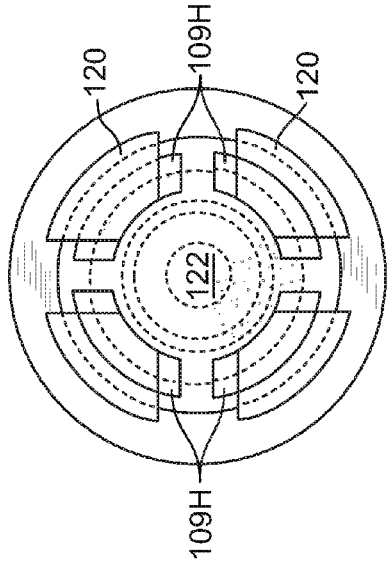
FIG. 6B depicts the embodiment of FIG. 6A in top plan view.
Figure 6A:
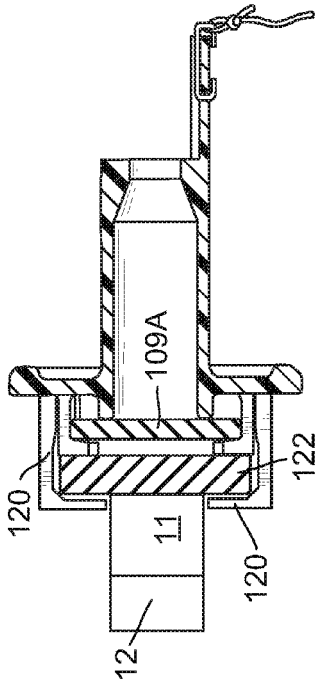
FIG. 6A depicts an embodiment of a lighted balloon inflation device in cross section elevation view.

A variation of the prior art filler of FIGS. 5A and 5B is shown in FIGS. 6A and 6B. A seen therein, a magnet 122 is mounted atop the lower cage fingers 109H, and is restrained in place by upper cage fingers 120. In this embodiment the magnet does not affect the operation of the check valve in the head, but provides a means for securely retaining the light-emitting assembly.

When using the filler-type device which also illuminates the inside of the balloon, the device is first inserted into the balloon, and then filled with the helium after insertion. Such a variation has the advantage of minimizing the amount of helium lost when the balloon is first filled and then the device is inserted afterwards.

In all of these embodiments the lighting element itself may be of various types. The preferring lighting element is a light-emitting diode (hereinafter "LED") because of the availability of many different types of LEDs, available at very low prices, and further because of the extremely high efficiency and low power drain on the battery caused by the LED. Among the variations commercially available are LEDs which blink, which change color, and combinations of these two effects.

Figure 4A:
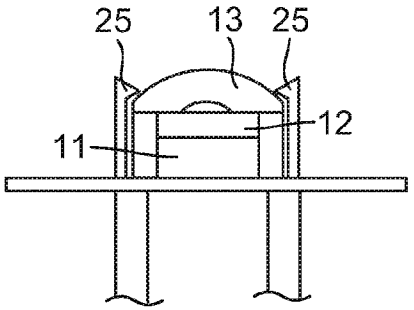
FIG. 4A depicts an embodiment of the present invention in which the light element is affixed by means of barbs.

In addition to the magnetic mounting embodiment, many different approaches to mounting of the LED are proposed herein as further embodiments. Referring first to FIG. 4A, the assembly holding the light-emitting element 13 is restrained by barbed fingers 25. The embodiment shown in this figure contains a self-contained light-emitting element having its own battery. It is clear that embodiments in which the battery and LED are separate units may also be used.

Figure 4B:
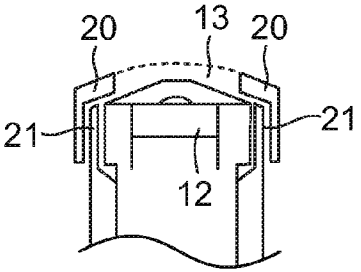
FIG. 4B depicts an embodiment of the present invention in which the light element is affixed by means of restraint fingers.

In FIG. 4B, a retaining ring 20 is force-fit over a mating enclosure 21 which contains the light-emitting element and battery. In a variation of the embodiment of FIG. 4B a screw-on retaining ring mates with mating threads on the enclosure 21.

Alternative versions are proposed herein for the switching of the light element on and off. In the preferred embodiment depicted in FIG. 1A the user must rotate the upper housing 12 relative to the lower housing 11, as previously stated.

Figure 4C:
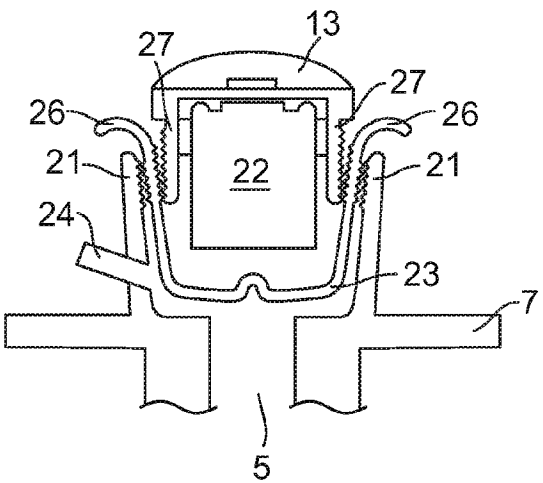
FIG. 4C depicts an embodiment in which the pressure of gas in the balloon switches on and off the lighting element, in the "off" position.
Figure 4D:
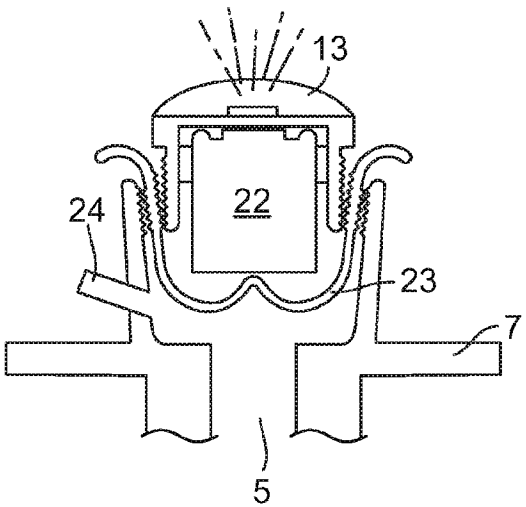
FIG. 4D depicts an embodiment in which the pressure of gas in the balloon switches on and off the lighting element, in the "on" position.

In another alternative embodiment, the filling of the balloon with helium is used to switch the light element on. Referring first to FIG. 4C, this embodiment contains a battery 22 which is in permanent electrical contact with positive terminal of the LED assembly 13. Ground connection is made by metallic element 23, which is configured to keep the helium from passing into the balloon. Helium enters the balloon only through the port 24. In FIG. 4C helium has not yet been inserted into the balloon: element 23 blocks the helium from entering the balloon except through port 24. As the helium is first introduced contact element 23 blocks port 24. At this stage the helium will force contact element 23 upwards until contact is made with the negative electrode of the battery, thereby completing the electrical circuit and causing the LED to illuminate, as shown in FIG. 4D. The teeth on mating enclosure 21, contact element arms 26, and light-element arms 27 form a ratchet mechanism, so that the contact element will stay in the position of FIG. 4D once the balloon is filled with helium, which is facilitated as the contact element rises to clear port 24, allowing the gas into the balloon through this route.

Figure 7C:
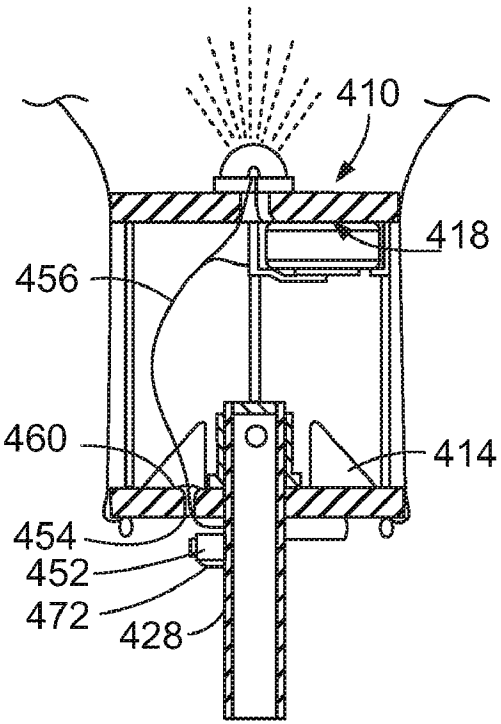
FIGS. 7A-7C illustrates alternate embodiments of the illuminated inflator device.
Figure 7B:
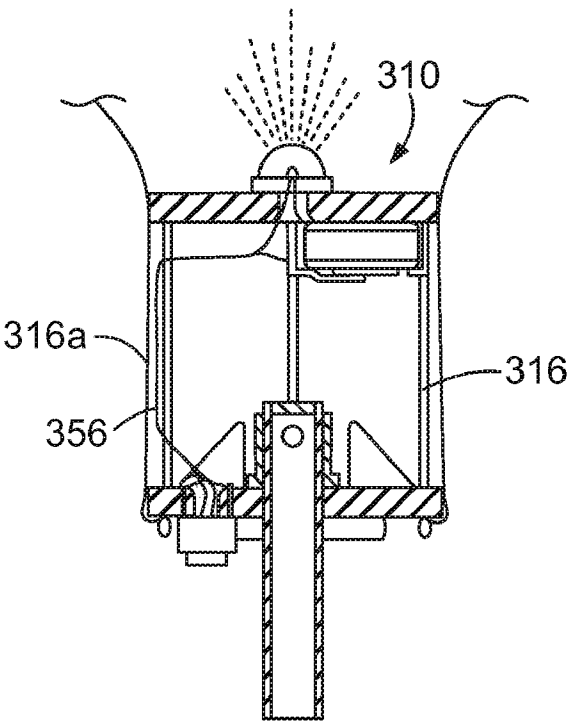
Figure 7A:
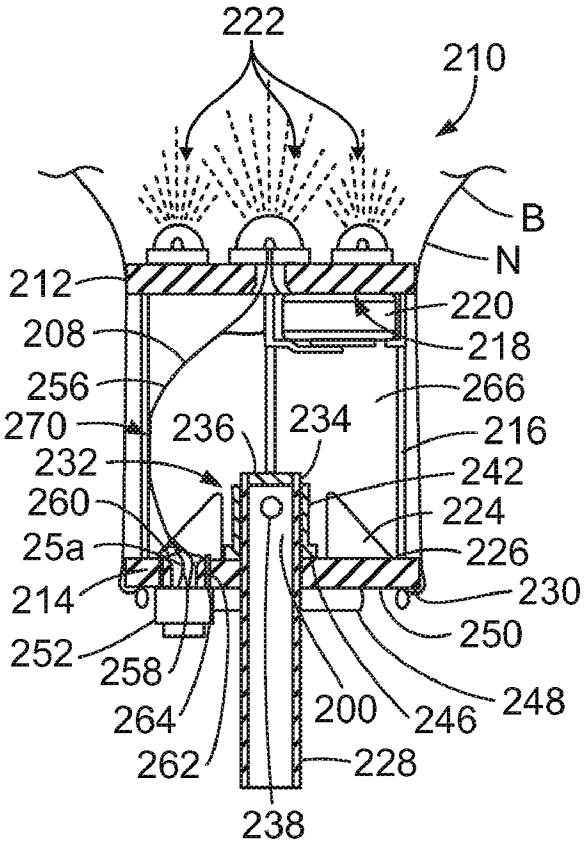

Alternate embodiments of the illuminating device are shown in FIGS. 7A-C. As seen in FIG. 7A, upper and lower flanges 212, 214 are spaced from one another by legs 216. The upper flange 212 includes circuitry 218, batteries 220, and one or more LEDs 222 for illuminating the balloon B. The upper flange 212 can be formed as a circuit board (IC board) with the batteries 220 and LED(s) 222 mounted directly thereto, or the circuitry 218 (board), batteries 220 and LED(s) 222 can be mounted to a separate flange element (not shown). In a present embodiment, the flange 212 is formed as the board and three legs 216 mount the board 212 to the device 210. A present embodiment of the device 210 includes three (3) LEDs 222, however, it will be appreciated that any number of LEDs can be mounted to the device 210.

The lower flange 214 provides a seal between the device 210 and the neck N of the balloon B, at the periphery 230 of the flange 214. The legs 216 extend upwardly from the lower flange 214 to support the upper flange 212 (or board). In a present embodiment, the device 210 is formed with upwardly extending gussets 224 formed radially on the upper surface 226 of the lower flange 214 to provide additional support (e.g., stiffness) for the flange 214.

A fill stem 228 extends downwardly (relative to the legs 216) from the lower flange 214 inside of the periphery 230 of the flange 214. In a present embodiment, the stem 228 is concentrically disposed with the flange 214. The fill stem 228 is a hollow tubular element. A one-way or check valve 232 is positioned in flow communication with the fill stem 228. The valve 232 permits the one-way flow of gas from a source (such as tank or fill nipple) into the balloon B. In a present device 210, the top or end 234 of the stem 228 is closed such as by a plug 236, and an opening 238 is formed in a side wall 240 of the stem 228, near the end 234, below the plug 236. The valve 232 is formed as a flexible sleeve 242 that is fitted over the upper end 234 of the stem 228, covering the opening 238. In a present embodiment, the opening 238 is formed near the stem end 234, and the sleeve 242 is sufficiently thick and extends only slightly beyond the stem opening 238. As pressurized gas is introduced into the stem 228, the gas pressure overcomes over the force of the resilient sleeve, and the sleeve slightly deforms (opens outwardly) to allow the gas to "escape" from the opening 238, past the edge 244 of the sleeve 242, and into the balloon B. When the inlet (feed) pressure of the introduced gas drops off (e.g., removing the inflator from the fill nipple), the resilience of the sleeve 242 closes the sleeve 242 over the opening 238 to seal the inflator 210. The sleeve 242 is fitted sufficiently tightly to the stem 228 so that even a high fill pressure and/or rate will not dislodge the sleeve 242 from the stem 228. Rather, the sleeve 242 will be forced outwardly at about the opening 238 to allow the gas to move from the high pressure region (inside the stem 228) to the lower pressure region (inside the balloon B). In a present embodiment, the sleeve 242 has a thickened ring portion 246, at the bottom of the sleeve 242 to further assure that the sleeve 242 remains on stem 228 as the balloon B is filled.

Radial gussets 248 can also be formed extending downwardly from the lower surface 250 of the lower flange 214 to provide additional support (e.g., stiffness) for the flange 214.

As set forth above, one of the drawbacks with known inflators is that the switch to illuminate the lights (LEDs) is located on the upper flange, in the interior of the balloon. While this has made fabrication of the inflators easier, because the balloons are translucent (at best) it requires that a user poke his or her finger around the balloon to locate and activate the switch. Hunting for the switch is even more exaggerated given that the circuitry may be such that different operating modes (e.g., flashing, pulsating, steady on) may be achieved by multiple pressings of the switch.

The present illumination device 210 overcomes all of these problems by locating the switch 252 outside of the balloon B or outside of the pressurized region. In one embodiment, the switch 252 is located on the lower surface 250 of the lower flange 214. An opening 254 in the lower flange 214 accommodates the electrical connectors (wires) 256 that extend between the switch 252 and the circuitry 218, circuit board, batteries 220 or other component to which the connectors 256 are terminated. The opening 254 can be formed having a taper 258, and an air-tight filler 260 is applied to the opening 254 around the connectors 256. The filler 260 can be an adhesive, a liquefied polymer, hot-melt (adhesive), a mechanical plug or the like, and is applied after placement or penetration to the connectors 256 to assure integrity of the pressure boundary.

The switch 252 can be affixed to the lower flange 214 in any of a number of ways. For example, the switch 252 can be glued/adhered to the flange 214, or, alternately, the switch 252 can have mounting posts 262 that extend from the base of the switch 252 through mount openings 264 in the lower flange 214. The posts 262 can then be glued/adhered, or melted, to secure the switch 252 to the flange 214. The post openings can also be sealed with an adhesive 260 or the like to prevent the escape of gas from the balloon.

The electrical connectors 256 extend from the switch 252, through the opening 254, to the circuitry 218 or other termination location. In a present embodiment, the connectors 256 extend through the space 266 between the flanges 212, 214. The connectors 256 can be fitted in one jacket 268, and/or tied to one of the legs 216, as by a wire tie 270, a clip or the like to maintain the connectors 256 restrained and protected. Alternately, as seen in FIG. 7B, one of the legs **316*a* can be formed as a hollow tube or conduit and the connectors 356 can be passed through the tube 316*a* to restrain and protect the connectors 356**.

Alternately still, the illuminator 410 can be configured with the switch 452 mounted on the stem 428, below the lower flange 414. An opening 454 in the lower flange 414 accommodates the connectors 456 which extend to the circuitry 481 (or board 412). The switch 452 can be mounted to the stem 428 by an adhesive, such as a hot melt adhesive. Flanges 472 can be formed on or mounted to the stem 428 to support and secure the switch 452. The opening 454 in the flange 414 can be sealed with an air-tight filler 460 applied to the opening 454 around the connectors 456. The filler 460 can be an adhesive, a liquefied polymer, hot-melt (adhesive), a mechanical plug or the like.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. An illuminated inflator for inserting into the neck of a balloon, comprising:

a gas-tight flange having a periphery, a center, and upper and lower surfaces;

a filler tube having upper and lower ends, the filler tube extending through the flange, with the lower end of the filler tube extending below the lower surface of the flange and the upper end of the filler tube extending above the upper surface of the flange;

a one-way valve in flow communication with the filler tube;

a light assembly including a power source and at least one light element electrically connected to the power source, the light assembly operably mounted to the flange at the upper surface thereof, a switch operably connected to the power source and the at least one light element for providing power to and isolating power from the at least one light element, wherein the inflator is inserted into the balloon with the flange in the neck of the balloon defining a pressure region boundary, and the bottom of the filler tube extends outside of the pressure region boundary for filling the balloon with a gas, such that the one-way valve prevents gas from escaping from the pressure region boundary through the filler tube, and wherein the switch is mounted to the inflator outside of the pressure region boundary on one of the gas-tight flange or the filler tube.

2. The illuminated inflator in accordance with claim 1 including an electrical connector extending between the switch and light assembly.

3. The illuminated inflator in accordance with claim 1 wherein the light assembly is mounted to and spaced from the gas-tight flange.

4. The illuminated inflator in accordance with claim 3 including legs extending between the gas-tight flange and the light assembly to elevate the light assembly.

5. The illuminated inflator in accordance with claim 1 wherein the light element is an LED.

6. The illuminated inflator in accordance with claim 5 including three LEDs.

7. The illuminated inflator in accordance with claim 1 including circuitry to steady illumination of the light element.

8. The illuminated inflator in accordance with claim 7 including circuitry to switch between a variety of illumination operating modes.

9. An illuminated inflator for inserting into the neck of a balloon, comprising:

a gas-tight flange having a periphery, a center, and upper and lower surfaces;

a filler tube having upper and lower ends, the filler tube extending through the flange, with the lower end of the filler tube extending below the lower surface of the flange and the upper end of the filler tube extending above the upper surface of the flange;

a one-way valve on the filler tube at about the upper end;

a light assembly including a power source and at least one light element electrically connected to the power source, the light assembly operably mounted to the flange by legs to secure the light assembly to the flange in spaced relation thereto, a switch operably connected to the power source and the at least one light element for providing power to and isolating power from the at least one light element, wherein the inflator is inserted into the balloon with the flange in the neck of the balloon defining a pressure region boundary, the bottom of the filler tube extending outside of the pressure region boundary for filling the balloon with a gas, such that the one-way valve prevents gas from escaping from the pressure region boundary through the filler tube, and wherein the switch is mounted outside of the pressure region boundary on one of the gas-tight flange or the filler tube.

* * * * *